US005621932A

United States Patent [19]

Strachan

[11] Patent Number: 5,621,932

[45] Date of Patent: Apr. 22, 1997

[54] PATIENT SUPPORT SYSTEMS

[75] Inventor: Julie Strachan, Hove, England

[73] Assignee: Smiths Industries Public Limited, London, England

[21] Appl. No.: 510,925

[22] Filed: Aug. 3, 1995

[30] Foreign Application Priority Data

Aug. 20, 1994 [GB] United Kingdom ..... 9416888

[51] Int. Cl.[6] ..... A61G 7/10

[52] U.S. Cl. ..... 5/600; 5/620

[58] Field of Search ..... 5/600, 611, 620, 5/86.1

[56] References Cited

U.S. PATENT DOCUMENTS

| | | | |
|---|---|---|---|
| 3,167,789 | 2/1965 | Wicks . | |
| 3,362,704 | 1/1968 | Pilz | 5/620 X |
| 4,101,120 | 7/1978 | Seshima . | |
| 4,778,164 | 10/1988 | Mueller et al. . | |
| 5,083,331 | 1/1992 | Schnelle et al. . | |
| 5,154,562 | 10/1992 | Dornauer . | |
| 5,279,011 | 1/1994 | Schnelle | 5/620 |

FOREIGN PATENT DOCUMENTS

| | | |
|---|---|---|
| 0625348 | 11/1994 | European Pat. Off. . |
| 1322712 | 2/1963 | France . |
| 1426751 | 12/1965 | France . |
| 2525702 | 10/1983 | France . |
| 2056378 | 3/1981 | United Kingdom . |
| WO90/03157 | 4/1990 | WIPO . |

*Primary Examiner*—Michael F. Trettel
*Attorney, Agent, or Firm*—Pollock, Vande Sande & Priddy

[57] ABSTRACT

A patient support system comprises an operating table, a patient transporter and a table top that can be moved from the transporter to the pedestal of the table. A platform at the top of the pedestal has a lateral hinge and two hydraulically-operated locks located at the hinge, which engage with the table top. The table top carries four secondary locks that are operated by actuators in the platform to cause the locks to engage or disengage the transporter. Lock sensors cause the platform to move when they detect incomplete engagement of the locks.

10 Claims, 2 Drawing Sheets

PATIENT SUPPORT SYSTEMS

BACKGROUND OF THE INVENTION

This invention relates to patient support systems.

The invention is more particularly concerned with support systems such as operating tables or transfer trolleys where the top, patient support surface, is removable from the remainder of the table or trolley. Removable tops enable the patient to be transferred from a trolley to the operating table and back to the trolley with a minimum of disturbance to the patient. It is important with such systems to ensure that the top is securely fastened to the base of the table so that the table top can be safely raised and lowered and put into any desired attitude.

BRIEF SUMMARY OF THE PRESENT INVENTION

It is an object of the present invention to provide a patient support system with a removable top and which has a high degree of safety.

According to one aspect of the present invention there is provided a patient support system having a base assembly and a patient support member that is removable from the base assembly, the support system having a lock that is movable between a first, unlocked state and a second, locking state and lock sensing means associated with the lock to detect the state of the lock and to provide an indication thereof.

The system preferably has a plurality of locks. The patient support system may include means for adjusting the position of the base assembly in response to the output of the lock sensing means when the lock sensing means indicates incomplete locking, the adjusting means being arranged to adjust the base assembly so that the or each lock that is incompletely locked can be fully locked. The lock preferably includes a horizontal shaft and a prime mover, such as including an hydraulic cylinder, arranged to displace the shaft outwardly or inwardly. The system may include two primary locks, one on each side of the patient support member, the primary locks being located at a hinge of a platform and the secondary locks located on either side of the hinge. The secondary locks preferably each have a horizontal shaft slidably mounted in the patient support member, the inner end of the shaft of each secondary lock being arranged for engagement by the upper surface of a respective actuator, and the shaft of each secondary lock being displaceable along its length by operation of an actuator.

According to another aspect of the present invention there is provided a patient support system comprising an operating table base with a platform at its upper end, a patient transporter and a patient support member that can be secured to either the operating table platform or the transporter, the platform having a lateral hinge, two primary locks located at opposite ends of the hinge that are movable between a first, unlocked state and a second, locking state where the locks engage the patient support member, lock sensing means associated with the locks to detect the state of the locks and to provide an indication thereof, a secondary lock including a member movably mounted with the patient support member, and an actuator mounted with the platform that is operable to move the secondary lock member from a first unlocked position to a second position in which the member engages and locks with the transporter.

The secondary lock preferably enables the patient support member to be raised or lowered relative to the transfer trolley when it is in an unlocked position. The system may include two pairs of secondary locks located on opposite sides of the hinge. The actuators may be hydraulic actuators.

An operating table in accordance with the present invention will now be described, by way of example, with reference to the accompanying drawings.

DETAILED DESCRIPTION OF THE PREFERRED EMBODIMENT

Figure 1:
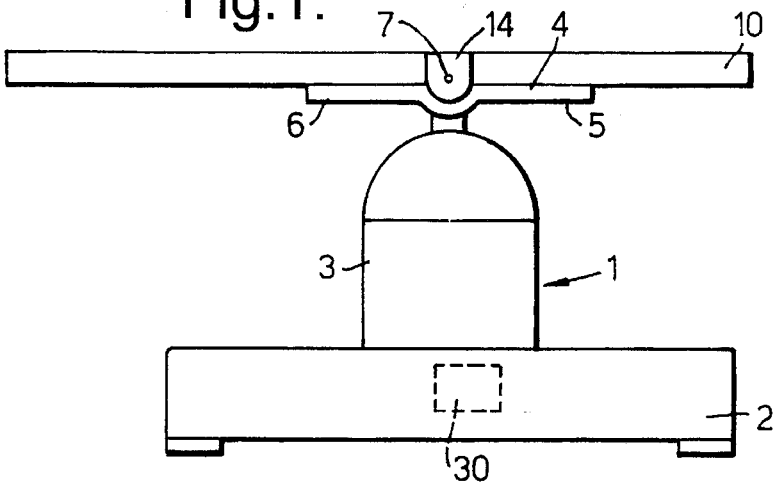
FIG. 1 is an elevation view of the table.
Figure 2:
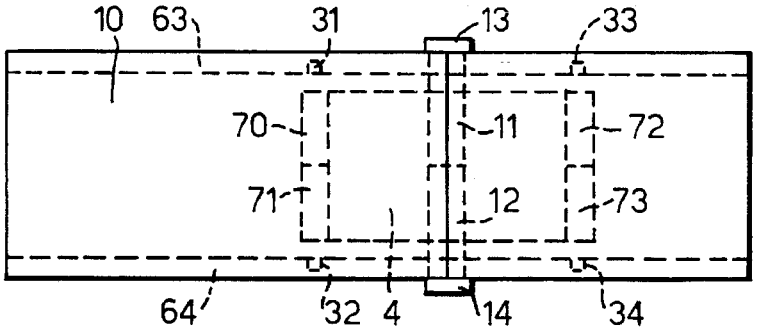
FIG. 2 is a plan view of the top of the table.
Figure 3:
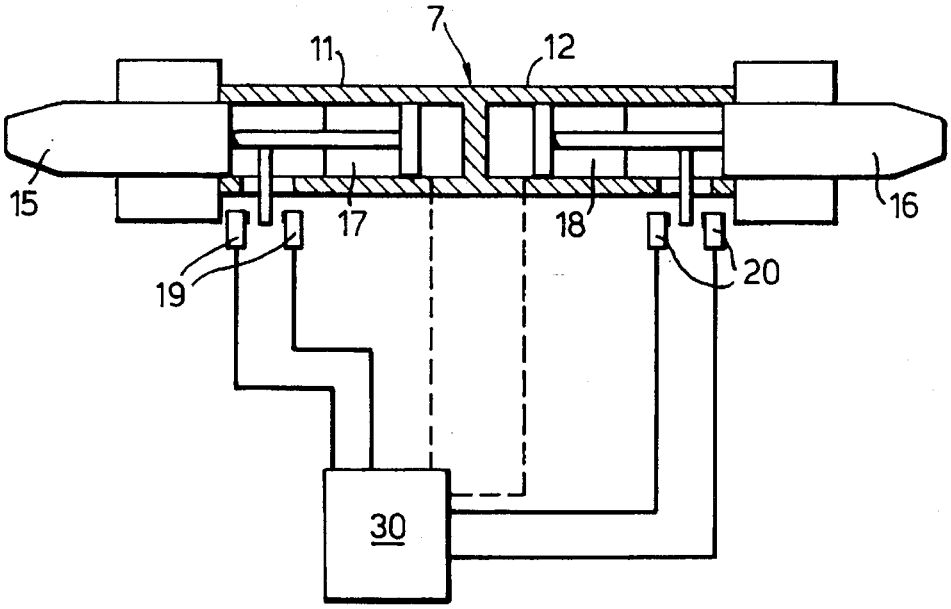
FIG. 3 is a sectional plan view of a part of the table.

With reference to FIGS. 1 to 3, the operating table 1 has a base assembly comprising a base plate 2 and a pedestal 3, which is adjustable in height in the usual way. At its upper end, the pedestal 3 supports a platform 4 having two leaves 5 and 6 hinged about a lateral, horizontal hinge 7. The operating table 1 also includes various actuators (not shown) of conventional construction by which the angle of the leaves 5 and 6 can be adjusted. The platform 4 supports a table top 10 on which the patient is supported. The table top 10 is, during use, locked to the platform 4 by means of two central locks 11 and 12. The central locks 11 and 12 are mounted on the pedestal 3, and engage locking plates 13 and 14 projecting down from the table top on opposite sides. The locks 11 and 12 are provided by two horizontal expanding shafts 15 and 16 incorporated into the hinge 7 of the platform 4. The shafts 15 and 16 can be displaced laterally out or inwardly by respective prime movers 17 and 18, such as solenoids or hydraulic cylinders. Coupled to each shaft 15 and 16 is a respective lock sensor 19 and 20 in the form of a pair of microswitches that detect whether the shaft is at its correct fully-extended locking position or is retracted. The prime movers 17 and 18 and the sensors 19 and 20 are connected to a microprocessor controller 30, which is located in the base 2.

Figure 4:
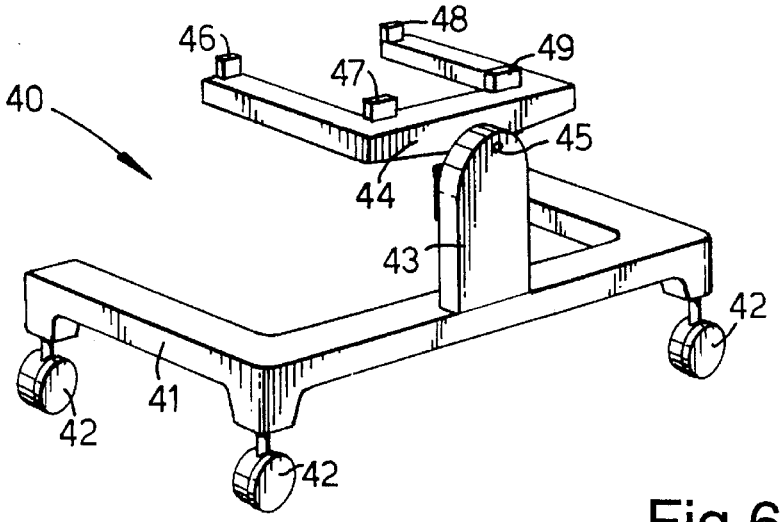
FIG. 4 is a perspective view of a transfer trolley used with the table.
Figure 5:
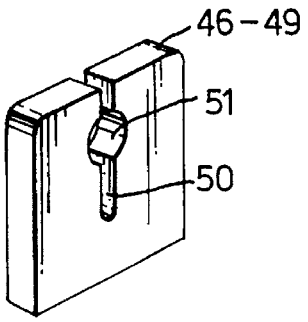
FIG. 5 is an enlarged perspective view of a part of the trolley of FIG. 4.
Figure 6:
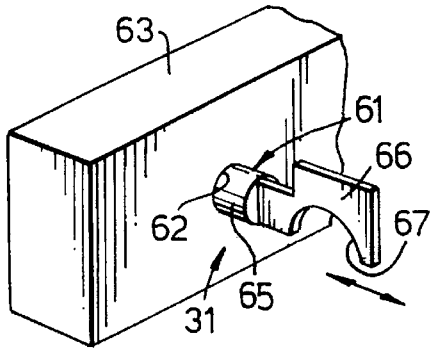
FIG. 6 is a perspective view of a lock on the table top.
Figure 7:
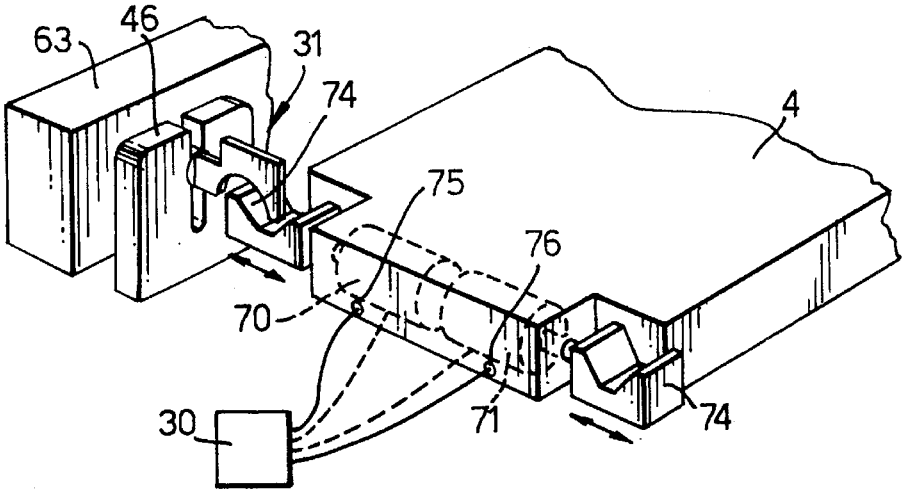
FIG. 7 is a perspective view showing the lock of FIG. 6 showing it engaged with the trolley.

Four secondary locks 31 to 34 are mounted in the table top itself and are used for securing the table top to a patient transfer trolley or transporter 40, as shown in FIG. 4. The transporter 40 has a U-shape base 41, with castors 42 at each comer, from which projects a vertical column 43. The column 43 supports a U-shape frame 44 hinged to the column by a pivot 45. At each comer of thee frame 44 projects one of four vertical locking plates 46 to 49, shown in more detail in FIG. 5. Each plate has a vertical slot 50 of rectangular shape with an enlarged opening 51 of circular section approximately midway along the slot. The slot 50 has an opening at its upper end, which is narrower than the circular opening. The secondary locks 31 to 34 on the table top 10 are located to engage the locking plates 46 to 49 when the top is on the transporter 40. FIG. 6 shows one of the locks 31, the others 32 to 34 being of identical construction. Each lock 31 to 34 comprises a horizontal shaft 61 slidable axially along a recess 62 in two parallel beams 63 and 64 extending longitudinally of the table top 10. The shafts 61 project inwardly from the beams 63 and 64 in two pairs, at locations aligned with the ends of the platform 4 when the table top 10 is mounted on the operating table 1. The shafts 61 each have a rear portion 65 of cylindrical section located in the recess 62 and a forward portion 66 of narrower, rectangular section projecting from the recess. The shape and dimensions of the shafts 61 are such that the cylindrical section 65 is a close fit in the enlarged circular opening 51 in the locking plates 46 to 49 whereas the rectangular portion 66 is a free sliding fit within the rectangular part of the slot 50. The rectangular portion 66 has a locating notch 67 cut into its lower edge for a purpose that will become apparent later. The shafts 61 are restrained from rotation about their axes. The locks 31 to 34 are actuated by four actuators 70 to 73 (such as solenoids or hydraulic cylinders) located in the platform 4, as shown in FIG. 7. The actuators 70 to 73 project horizontally outwardly of the platform 4 and are movable outwardly and inwardly along their length under control of the controller 30. Each actuator 70 to 73 has a dog 74, the upper surface of which is shaped to engage the notch 67 in the forward portion 66 of the lock shafts 61. Four sensors, only two of which 75 and 76 are shown, detect the position of the actuators and hence the state of the locks 31 to 34.

When mounted on the operating table 1, the actuators 70 to 73 are fully extended and the locks 31 to 34 are, therefore, fully retracted so that they can receive the locking plates 46 to 49 of the transporter 40. During transfer, the transporter 40 is pushed up to the operating table 1 and the upper frame 44 is positioned below the table top 10 with the locking plates 46 to 49 aligned with the locks 31 to 34. The table top 10 is then lowered so that the rectangular portions 66 of the lock shafts 61 enter the respective slots 50 in the locking plates 46 to 49. The actuators 70 to 73 are then actuated to change the state of the locks so that the shafts 61 are pulled inwardly, out of the beams 63 and 64, so that the cylindrical portion of each shaft enters the circular opening 51 in the slots. It can be seen that the cylindrical portion of the shafts cannot be moved along the slots so the locks securely retain the table top. The central locks 11 and 12 are then released to release the top 10 from the pedestal 3, which is lowered to allow the transporter 40 to be pulled away with the top locked securely to its upper frame 44.

When the table top 10 is to be loaded back onto the operating table 1, the transporter 40 is pushed up to the table with the pedestal 3 in a low position. The pedestal is then raised until a switch in the pedestal (not shown) detects that it is at the correct height for transfer. At this point the pedestal 3 halts and the central locks 11 and 12 extend to engage sockets in the locking plates 13 and 14 on the tale top 10. When the locks 11 and 12 are correctly engaged they will be fully extended; any failure to extend fully would be indicated by the sensors 19 and 20 as a fault. Thus, if the table top 10 were positioned too high, the locks 11 and 12 would abut the beams 63 and 64 and not be able to extend fully, thereby giving a fault indication. The controller 30 interprets these outputs from the sensors 19 and 20 as a fault and aborts the transfer process. If the top were misaligned, some of the locks might not be able to extend fully, thereby also indicating a fault. For example, if one of the locks were to engage and the other did not, this would mean that the unengaged lock was too low for correct engagement. The controller 30 identifies this condition and attempts to rectify it by causing the platform 4 to perform a lateral tilt manoeuvre to raise the unengaged lock and to lower the engaged lock. The controller then attempts to engage the unengaged lock. If the controller is successful in engaging both central locks 11 and 12, it then attempts to disengage the locks 31 to 34 used to hold the top 10 on the transporter 40. By doing this only after the central locks are fully locked it ensures that the table top is either safely locked to the operating table or to the transporter.

If all four secondary locks 31 to 34 were to fail to engage the actuators 70 to 73, the controller 30 would instruct the pedestal 3 to raise the platform 4 a predetermined amount and again attempt to engage the locks.

If all four secondary locks 31 to 34 were to fail to engage the actuators 70 to 73, the controller 30 would instruct the pedestal 3 to raise the platform 4 a predetermined amount and again attempt to engage the locks.

If two locks at one end of the platform were to engage and the two locks at the other end of the platform 4 were to fail to engage, the controller 30 would interpret this as indicating that the unengaged end was too low. In response to this,the controller 30 would cause the platform to exert a trendelenburg movement in which the unengaged end is raised and the engaged end is lowered. The controller 30 again attempts to engage the locks.

If, however, the locks on one side engage and those on the other side do not, the controller 30 would instruct the platform to perform a lateral tilt movement to raise the unengaged locks. An attempt is then made to engage the locks. In all circumstances, two attempts are made to engage a lock. If these attempts are unsuccessful, the controller aborts the transfer process, unlocks any locks that have engaged and returns the platform to its original position.

The present invention ensures that the table top is always safely locked to either the operating table or the transfer trolley and speeds the transfer process by automatically performing adjustments needed to position the platform correctly for locking engagement with the table top.

What I claim is:

1. A patient support system comprising: a base assembly having an adjustable pedestal; a patient support member comprising a pair of leaves hinged about a lateral hinge, said patient support member including a table top that is removably attachable to an upper end of said pedestal; a primary lock at said upper end of said pedestal, said primary lock having two lock members that are displaceable outwardly from a first, unlocked state to a second, locking state in which they engage with said patient support member in the region of said hinge; a lock sensor associated with said primary lock to detect the state of said lock and to provide an indication thereof; and secondary locks located on opposite sides of said hinge for engagement with said table top.

2. A patient support system according to claim 1, including means for adjusting the position of said patient support member in response to an output of said lock sensor that indicates incomplete locking of at least one of said locks, such that a said lock that is incompletely locked can be fully locked.

3. A patient support system according to claim 1, wherein each said lock member is a horizontal shaft, said primary lock including a hydraulic cylinder arranged to displace said shaft outwardly or inwardly.

4. A patient support system according to claim 1, including two pairs of said secondary locks, one pair on each side of said hinge.

5. A patient support system according to claim 4, wherein said secondary locks each have a horizontal shaft mounted for slidable movement relative to said table top, said shaft of each secondary lock being arranged for engagement by a respective actuator, and said shaft of each secondary lock being displaceable along its length by operation of the actuator.

6. A patient support system comprising: an operating table base, said table base having a platform at its upper end; a patient transporter; and a patient support member, said patient support member being securable to either said operating table platform or said transporter, wherein said platform has a lateral hinge, two primary locks located at opposite ends of said hinge, said primary locks being movable between a first, unlocked state and a second, locking state where said locks engage said patient support member, a lock sensor associated with said locks to detect the state of said locks and to provide an indication thereof, a secondary lock including a member movably mounted with said patient support member, and an actuator mounted with said platform that is operable to move said secondary lock member from a first unlocked position to a second position in which said member engages and locks with said transporter.

7. A patient support system according to claim 6, wherein said secondary lock enables said patient support member to be raised or lowered relative to said transporter when it is in an unlocked position.

8. A patient support system according to claim 6 including two pairs of secondary locks located on opposite sides of said hinge.

9. A patient support system comprising: a base assembly, said base assembly having a pedestal that is adjustable in height and a platform at an upper end of the pedestal, the platform having a lateral hinge; a patient support member; first and second primary locks on said platform at opposite ends of said hinge to engage with said patient support member; a transporter; a plurality of secondary locks for locking the patient support member with the transporter; and a plurality of actuators on the platform for engaging said secondary locks such that the patient support member can be locked to or unlocked from the transporter by actuation of said actuators.

10. A patient support system according to claim 9, wherein said locks and said actuators are hydraulically operated.

* * * * *